United States Patent [19]

Weinbrecht

[11] Patent Number: 4,859,158

[45] Date of Patent: Aug. 22, 1989

[54] HIGH RATIO RECIRCULATING GAS COMPRESSOR

[76] Inventor: John F. Weinbrecht, 601 Oakwood Pl., NE., Albuquerque, N. Mex. 87123

[21] Appl. No.: 121,663

[22] Filed: Nov. 16, 1987

[51] Int. Cl.[4] ..... F04C 18/18; F04C 23/00; F04C 29/04

[52] U.S. Cl. ..... 418/9; 418/15; 418/83; 418/180; 418/206; 417/243

[58] Field of Search ..... 418/9, 15, 83, 86, 180, 418/206; 417/243

[56] References Cited

U.S. PATENT DOCUMENTS

| | | | |
|---|---|---|---|
| 2,489,887 | 11/1949 | Houghton | 418/180 |
| 2,906,448 | 9/1959 | Lorenz | 418/206 |
| 3,531,227 | 9/1970 | Weatherston | 418/180 |
| 4,390,331 | 6/1983 | Nachtrieb | 418/206 |
| 4,453,901 | 6/1984 | Zimmerly | 418/206 |

FOREIGN PATENT DOCUMENTS

| | | | |
|---|---|---|---|
| 2027272 | 12/1971 | Fed. Rep. of Germany | 418/206 |
| 778367 | 12/1934 | France | 418/9 |

OTHER PUBLICATIONS

*Roots DVJ Dry Vacuum Whispair Blowers,* Dresser Industries Inc., Connersville, Indiana, Apr. 1982.

*Vacuum Generation by Means of Roots Vacuum Pumps,* Balzers Co., Hudson, N.H., May 1985.

*Primary Examiner*—John J. Vrablik

*Attorney, Agent, or Firm*—William A. Eklund

[57] ABSTRACT

A high ratio positive displacement recirculating rotary compressor is disclosed. The compressor includes an integral heat exchanger and recirculation conduits for returning cooled, high pressure discharge gas to the compressor housing to reducing heating of the compressor and enable higher pressure ratios to be sustained. The compressor features a recirculation system which results in continuous and uninterrupted flow of recirculation gas to the compressor with no direct leakage to either the discharge port or the intake port of the compressor, resulting in a capability of higher sustained pressure ratios without overheating of the compressor.

5 Claims, 7 Drawing Sheets

HIGH RATIO RECIRCULATING GAS COMPRESSOR

The U.S. Government has rights in this invention pursuant to contract No. W-7405-ENG-36 awarded by the U.S. Department of Energy.

BACKGROUND OF THE INVENTION

1. Field of the Invention

The invention described and claimed herein is generally related to positive displacement rotary gas compressors. More particularly, the present invention is related to a class of positive displacement rotary gas compressors commonly known as Roots pumps.

2. Description of the Related Art

The class of positive displacement gas compressors known as Roots compressors, or Roots blowers, has been known and used in industry for over a hundred years. It is well recognized in industry that for certain applications Roots compressors offer a number of advantages over other types of gas pumps and compressors, for example conventional piston-and-cylinder reciprocating pumps, fan-type blowers and turbine pumps. Among these advantages are simplicity, ruggedness, trouble-free operation, and high volumetric capacity. There are no valves, pistons or other reciprocating mechanical parts, and there are no rubbing mechanical parts. Additionally, there is little or no backflow, or leakage, even when the Roots compressor is not operating. A typical application of a Roots compressor is the transfer or evacuation of large amounts of toxic or corrosive gas, where it is important to rapidly pump large amounts of gas with little or no backflow. In this type of application reciprocating pumps are relatively inefficient, and fan-type blowers and turbine pumps cannot provide a seal against backflow.

Roots compressors most commonly include two lobed impellers (sometimes also called rotors) which intermesh with one another and rotate in opposite directions in synchronization within a housing. The impellers operate to sweep a gas through the housing from an intake manifold at one end of the housing to an output manifold at the opposite end of the housing. Although commercially available Roots compressors most commonly include impellers having only two lobes, Roots compressors have also been designed to include impellers having three, four and possibly even more lobes. Two-lobed impellers however are the most common because they are simpler and because the volumetric efficiency of a Roots compressor is inversely proportional to the proportion of the compressor chamber that is occupied by the impellers, and two-lobed impellers generally occupy the least volume.

While Roots compressors are extraordinarily efficient for the purpose of rapidly moving large volumes of gas where there is little or no pressure differential, they have heretofore been of limited application for the purpose of pumping a gas against a pressure differential. This limitation has been due to heating effects which attend such pumping. As a gas is swept through a Roots compressor from a region of relatively low pressure to a region of relatively higher pressure, it is compressed and heated. Such compression is essentially adiabatic, such that the temperature of the gas rises exponentially with increasing pressure ratios. The increase in the temperature of the gas leads to heating of the impellers, the housing and other mechanical parts of the pump.

This in turn can lead to thermal distortion, expansion and friction. At pressure ratios of greater than about two to one (2:1) such effects become a significant problem. Overheating of the compressor can result in lockup or other mechanical failure of the seals, impellers and other compressor components.

The heating problem is not uniform throughout the compressor. The compressor housing, for example, can be cooled by a number of conventional methods, such as the use of integral double-walled water jackets, heat radiating fins and the like. The greatest heating problem however lies with the impellers, as there is no practical way to directly cool the impellers. Overheating of the impellers leads to their expansion and eventual binding against the housing, possibly causing extensive damage to the compressor. Overheating of the Roots compressor has thus been one of the most significant limitations on the use of Roots compressors for pumping gas against pressure differentials, and for this reason commercially available Roots compressors are typically limited to pressure ratios of less than about four to one (4:1).

Perhaps the most simple and straightforward method of avoiding the adverse effects of overheating is to increase the clearances between the impellers and the housing, thereby allowing the impellers to expand somewhat on heating without rubbing and locking up against the housing. This however necessarily leads to increased leakage and backflow, and thereby degrades the volumetric efficiency of the compressor. For this reason this approach has not generally been considered a satsifactory solution to the overheating problem.

A substantial advance in the art was the development of recirculation cycles to effect a moderate reduction in the heating of Roots compressors. In a recirculating Roots compressor, a portion of the output gas, which is compressed and heated, is cooled, external to the compressor, and subsequently recirculated back into the compressor. This effectively reduces the rise in temperature of the gas within the compressor, thereby mitigating the heating problems described above.

U.S. Pat. No. 2,489,887 to Houghton, for example, discloses the concept of cooling the impellers of a Roots compressor by introducing recirculated gas of a lower temperature into the intake gas to reduce heating of the impellers. The teachings of the Houghton patent are discussed in greater detail below, in comparison with the present invention.

In prior art recirculating Roots compressors, such as the compressor disclosed in Houghton, the flow of recirculating gas is either interrupted each time a rotor lobe passes the recirculation entry port, or is halted and possibly reversed as a displacement cavity is simultaneously opened to both a recirculation port and a discharge port. This results in a loss of momentum and flow of the recirculation fluid, reducing the efficiency of the recirculation fluid in cooling the compressor. This problem, which is inherent in previously known Roots compressors, is overcome in the present invention, as will be made apparent by the descriptions set forth below.

Accordingly, it is the object and purpose of the present invention to provide an improved positive displacement rotary gas compressor.

It is also an object and purpose of the present invention to provide a positive displacement rotary compressor capable of sustained operation without overheating at high pressure ratios.

It is also an object and purpose of the present invention to provide a positive displacement rotary compressor having an improved gas recirculation means for reducing heating of the compressor.

It is a further object and purpose of the present invention to provide a positive displacement rotary compressor characterized by having a continuous, uninterrupted flow of cooled recirculation gas flowing from the output of the compressor back into the compressor housing.

It is also an object of the present invention to provide a positive displacement rotary compressor that produces less heat inside the compressor and is thus capable of operating at higher pressure ratios than have been previously sustainable.

SUMMARY OF THE INVENTION

The present invention provides a positive displacement recirculating rotary compressor. The compressor comprises a housing having mutually opposing cylindrically curved interior side walls, a gas inlet port located at one end of the housing between the cylindrically curved side walls, and a gas discharge port located at the opposite end of the housing from said inlet port and also located between the cylindrically curved side walls. The compressor further includes a pair of intermeshed, involutely lobed impellers which are rotatably journalled in the housing. The impellers are driven to rotate in opposite directions so as to sweep a gas from the inlet port to the discharge port.

The compressor further includes heat exchange means for cooling the gas that is discharged from the compressor at the discharge port, and recirculation conduits for recirculating the cooled, relatively high pressure discharge gas back into the compressor housing through recirculation ports which open into the housing at each of the cylindrically curved side walls. Further, the lobes of the impellers are shaped so as to not obstruct the recirculation ports as they rotate past the recirculation ports, thereby permitting continuous and uninterrupted flow of cooled recirculation gas into the housing at all times. Additionally, the number of lobes of the impellers and the angular reach of the cylindrically curved side walls, between the inlet and discharge ports, are selected so that the inlet port, the recirculation ports and the discharge port are at all times isolated from one another so as to prevent backflow due to direct fluid communication between these ports.

These and other aspects of the present invention will be more apparent upon consideration of the accompanying drawings and the following detailed description of the preferred embodiment of the invention.

BRIEF DESCRIPTION OF THE DRAWINGS

The accompanying drawings are incorporated in the specification and, when taken with the following detailed description of the preferred embodiment of the invention, illustrate the operation and construction of a preferred embodiment of the invention.

In the Figures.

DESCRIPTION OF THE PREFERRED EMBODIMENT

Figure 1:
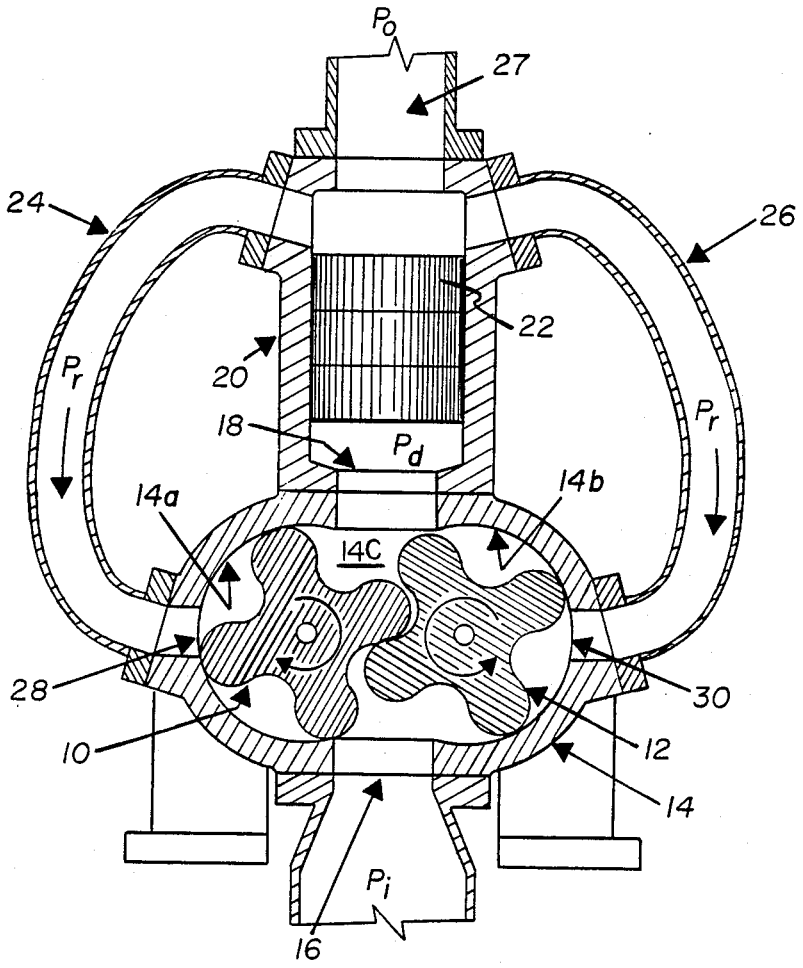
FIG. 1 is a side view in cross section of the preferred embodiment of the compressor of the present invention.
Figure 9:
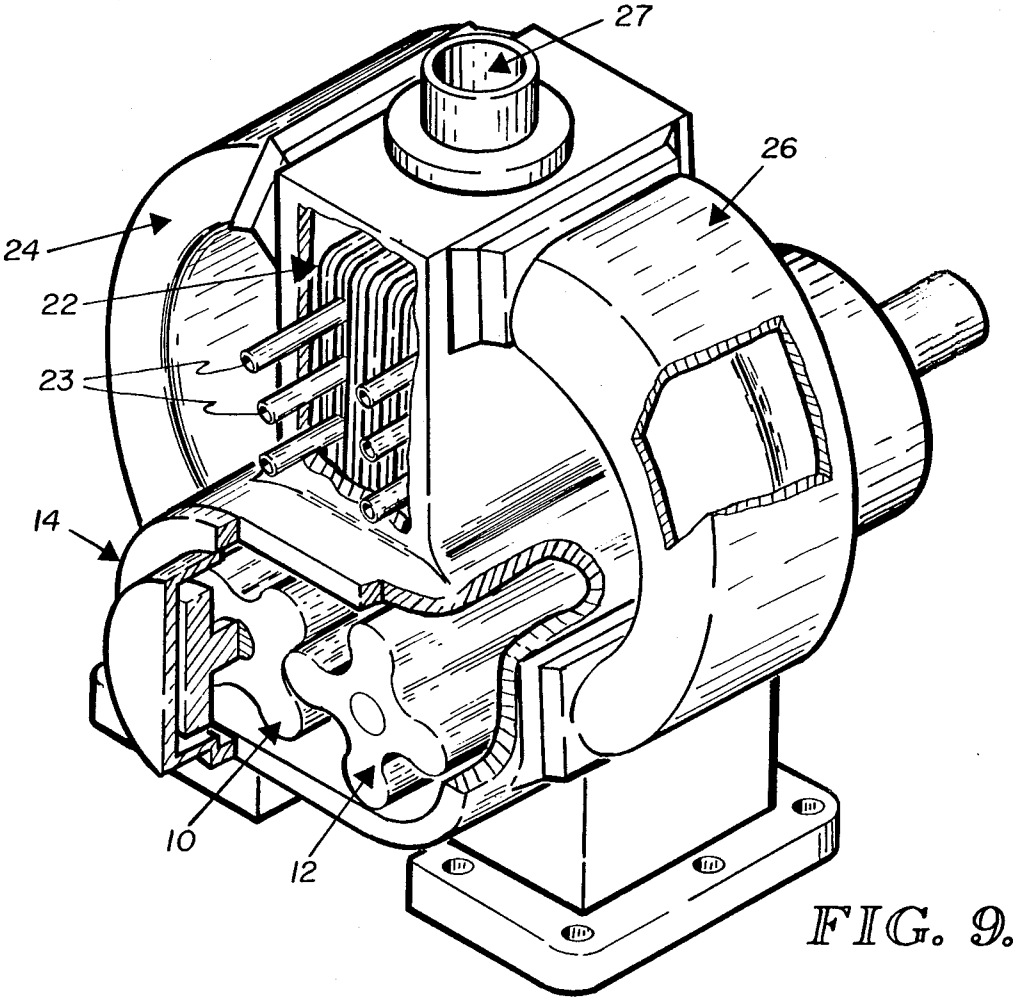
FIG. 9 is a partially cut away isometric view of a compressor substantially as shown of FIG. 1.

Referring particularly to FIGS. 1 and 9, there is illustrated a preferred embodiment of the positive displacement, recirculating rotary compressor of the present invention. The compressor includes two lobed impellers 10 and 12 which are rotatably mounted within a hollow housing 14. The housing 14 has an interior surface which includes two mutually opposing, cylindrically curved interior side walls **14*a* and 14*b*. The housing 14 further includes flat end walls, only one of which, 14*c*, is shown. Briefly, the diameters of the lobed impellers 10 and 12 correspond, to within a tolerance of a few thousandths of an inch, the diameters of cylindrically curved side walls. The lobed impellers 10 and 12 are substantially identical and will therefore be described in greater detail at various points below primarily by reference to the details of constructon and operation of the impeller 10, shown generally on the left-hand side of the Figures. The impellers 10 and 12 each have four substantially identical lobes. Two of the four identical lobes of the impeller 10 are identified as 10*a* and 10*b*** in certain of the Figures, for purposes of the description below.

Briefly, the impellers 10 and 12 are driven to rotate in opposite directions about parallel axes of rotation which extend along the central axes of the impellers. The axes of rotation of the impellers 10 and 12 are also colinear with the central longitudinal axes of the cylindrically curved interior walls **14*a* and 14*b*, respectively. The lobes of the impellers 10 and 12 have a maximum radius which is typically a few thousandths of an inch less than the geometric radius of the cylindricall curved side walls 14*a* and 14*b*. The impellers 10 and 12 are maintained in the proper angular relationship with one another, at an angular phase relationship of 45°, by means of timing gears (not shown) which are located outside the primary chamber of the housing 14**.

In operation, a gas is admitted to the compressor through a gas inlet port 16 formed at the lower end of the housing 14, and which is centered between the side walls **14*a* and 14*b*. The admitted gas is swept through the housing 14 by the impellers 10 and 12, and is discharged from the compressor through a discharge port 18 formed at the upper end of the housing from the inlet port 16, and which is also centered between the side walls 14*a* and 14*b*. In rotation, the lobes of the impellers 10 and 12** flushly intermesh with one another in the region between the two impellers, so that there are high-impedance clearances between the impellers that are small in comparison with the volumetric displacement of the compressor, and which essentially restrict, by sonic choking, backflow of gas through the compressor.

The lobed impeller geometry results in continuous mesh contact between the impellers 10 and 12 throughout full rotation, such that backflow of the gas occurs only as a consequence of the tolerance, or play, between the impellers. The lobe form is involute between tip and root radii.

Gas that is compressed and discharged from the discharge port 18 passes through a discharge conduit 20. The discharge conduit 20 contains a heat exchanger 22 which operates to cool the compressed and heated gas as it passes by the heat exchanger 22. A cooling fluid is carried through the heat exchanger 22 by means of coolant tubes 23, shown in FIG. 9. The heat exchanger 22 may be of any suitable low impedance design that is adequate to cool the compressed gas at the temperatures and flow rates encountered.

At a point downstream from the heat exchanger 22 the discharge conduit 20 is connected in fluid communication with a pair of recirculation conduits 24 and 26. The recirculation conduits 24 and 26 connect the discharge conduit 20 to recirculation ports 28 and 30, respectively, which open onto the cylindrically curved side walls 14*a* and 14*b* in the housing 14. The conduit 20 terminates in an outlet port 27, from which the compressed gas is discharged to its eventual destination.

The recirculation ports 28 and 30 open into the housing 14 so as to recycle cooled, high-pressure gas back into the pump housing 14, thereby raising the gas pressure within the housing, and thereby largely avoiding the heat gain from adiabatic compression within the compressor and reducing the tendency for the pump to overheat at high pressure ratios.

The principle of operation of the compressor is illustrated in greater detail by the series of schematic illustrations set forth in FIG. 2 through FIG. 8. These Figures illustrate the passage of a parcel of gas through the compressor in a step-by-step sequence. The following description of this sequence is primarily with reference to the left-hand half of the illustrated compressor, with it being understood that the operation of the right-hand side is identically the same. For convenience of description, the left-hand impeller 10 is illustrated as including four lobes, two of which are arbitrarily identified as lobes 10*a* and 10*b*. The operation of the compressor is perhaps best explained by following in some detail the course of a volume of gas as it is swept through the compressor.

Figure 2:
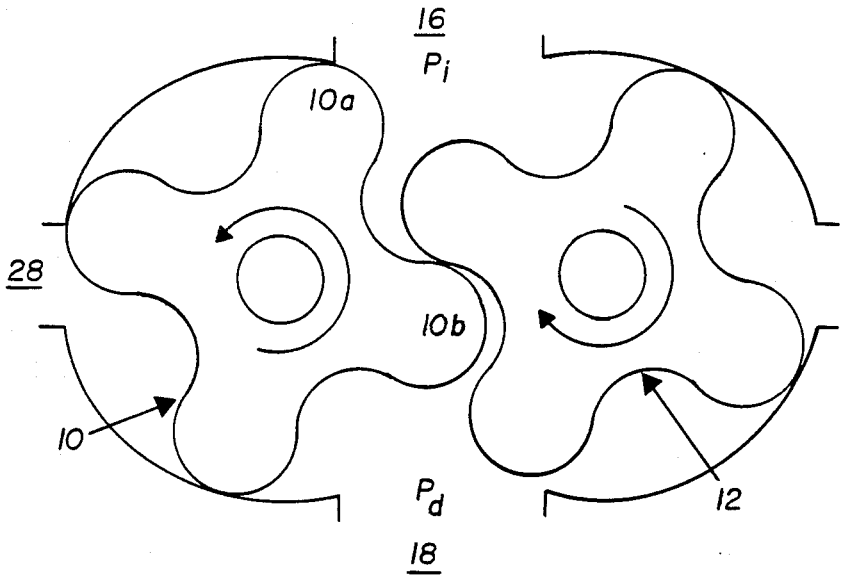
FIGS. 2 through 8 are schematic side views showing the operation of the compressor illustrated in FIG. 1.
Figure 3:
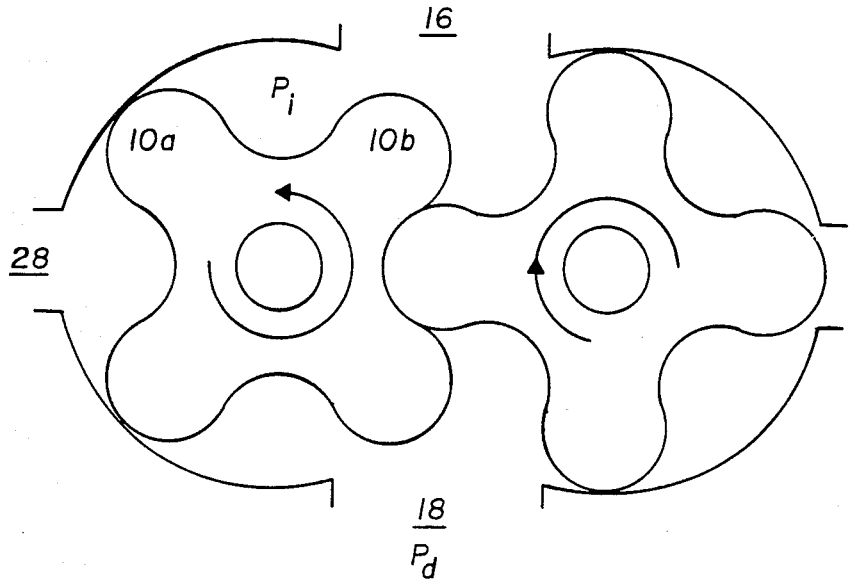
Figure 4:
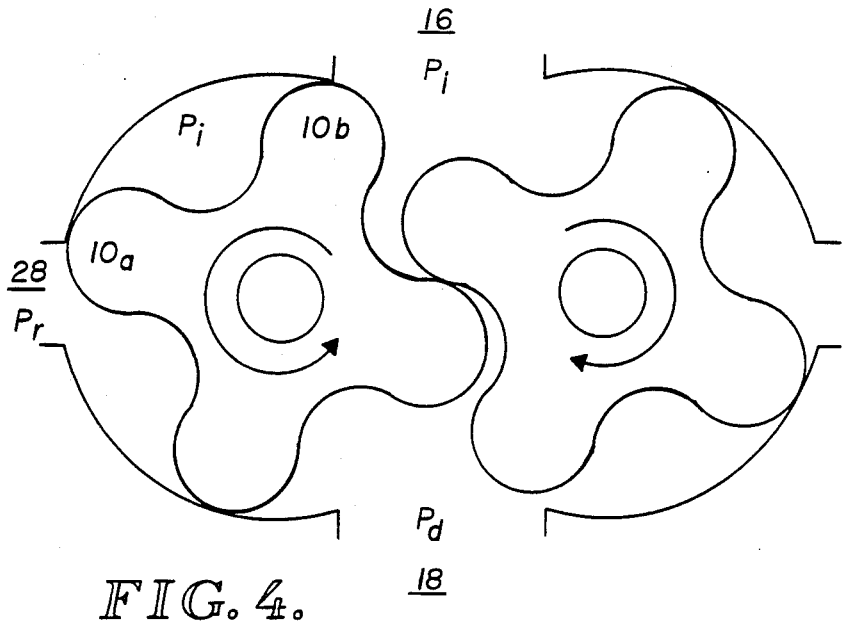

Referring first to FIG. 2, the compressor generally operates to pump a gas, which is at a relatively low inlet pressure ($P_i$) at the inlet port 16 of the compressor, to the discharge port 18 at a relatively higher discharge pressure $P_d$. In the first step gas is admitted to the chamber housing 14 through the inlet port 16. As lobe 10*a* rotates counterclockwise past the edge of inlet port 16, gas at the inlet pressure $P_i$ enters the region between lobes 10*a* and 10*b*, as shown in FIG. 3, still at pressure $P_i$. As lobe 10*b* passes the edge of the inlet port 16, a parcel of gas at pressure $P_i$ is trapped in the volume bounded by the lobes 10*a* and 10*b*, the cylindrically curved housing wall, and the flat end walls of the compressor housing. This volume is referred to herein as a displacement cavity. At the stage shown in FIG. 4, the parcel of gas is completely contained by the lobes 10*a* and 10*b* and the housing walls. At this point no compression of the parcel of gas has yet occurred, and the parcel of gas remains substantially at the inlet pressure $P_i$ in the displacement cavity.

Figure 5:
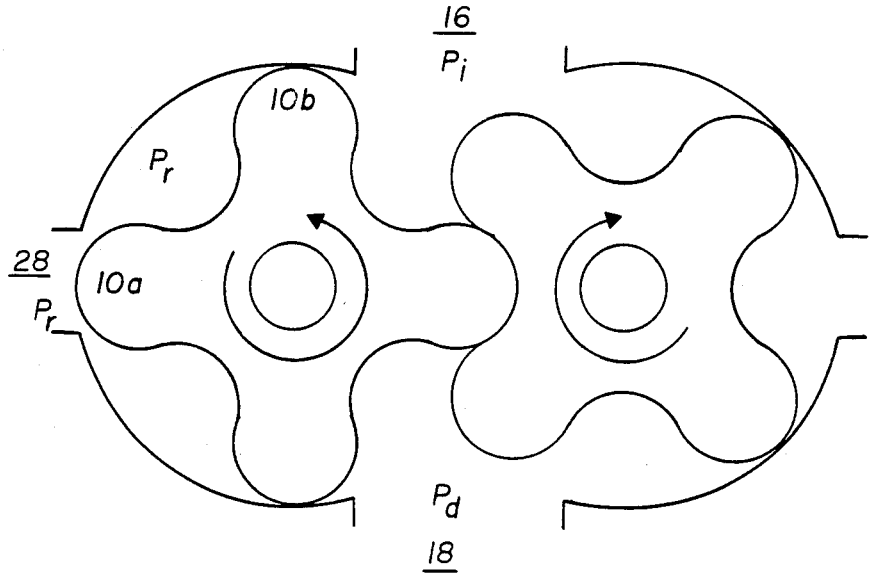

As the lobe 10*a* rotates counterclockwise past the leading edge of the recirculation port 28, as shown in FIG. 5, cooled recirculation gas at a relatively higher recirculation pressure ($P_r$) is admitted through the recirculation port 28 into the region between lobes 10*a* and 10*b*. The recirculation pressure $P_r$ is higher than the inlet pressure $P_i$. Consequently the recirculation gas mixes with the original parcel of gas that was swept into the housing between lobes 10*a* and 10*b* at pressure $P_i$, such that the total pressure in the displacement cavity is raised to pressure $P_r$. The recirculation gas gains some heat as it enters the displacement cavity, due to a phenomenon known alternatively as flow work or flow energy conversion. The resulting increase in temperature tends to reach a substantially constant value at pressure ratios greater than about five to one (5:1). This temperature increase is sufficiently moderate to permit high pressure ratio operation with reduced compressor clearances, without leading to thermal distortion and associated problems. The housing and the impellers operate at a temperature which is near that of the recirculation gas, and additional cooling measures are unnecessary.

As a consequence of the introduction of the recirculation gas, there is created a parcel of gas between lobes 10*a* and 10*b* which is at the pressure $P_r$ of the recirculation gas. This is shown best in FIG. 6.

Figure 7:
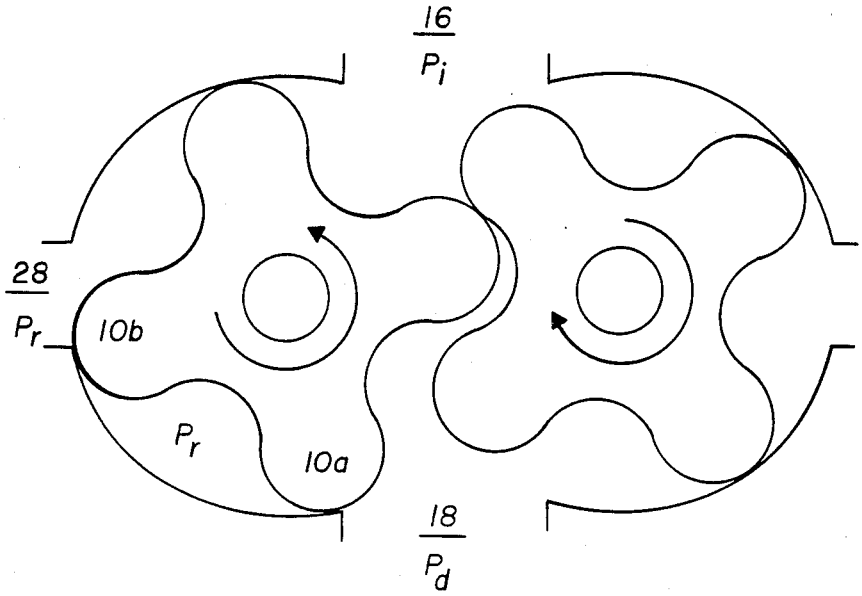

As the impeller 10 continues its revolution, the gas at pressure $P_r$ between lobes 10*a* and 10*b* is momentarily trapped between lobes 10*a* and 10*b* and is isolated from the both the recirculation gas at port 28 as well as from the discharge gas at port 18, as shown in FIG. 7. It will be seen that, up to the stage illustrated in FIG. 7, the net result of the impeller 10 having rotated from the initial position shown in FIG. 2 to the position shown in FIG. 7 is that a parcel of gas initially swept into the pump at low pressure $P_i$ is admixed with cooled recirculation gas as the displacement cavity pressure is raised to the pressure $P_r$ of the recirculation gas, with only moderate change in temperature.

Figure 8:
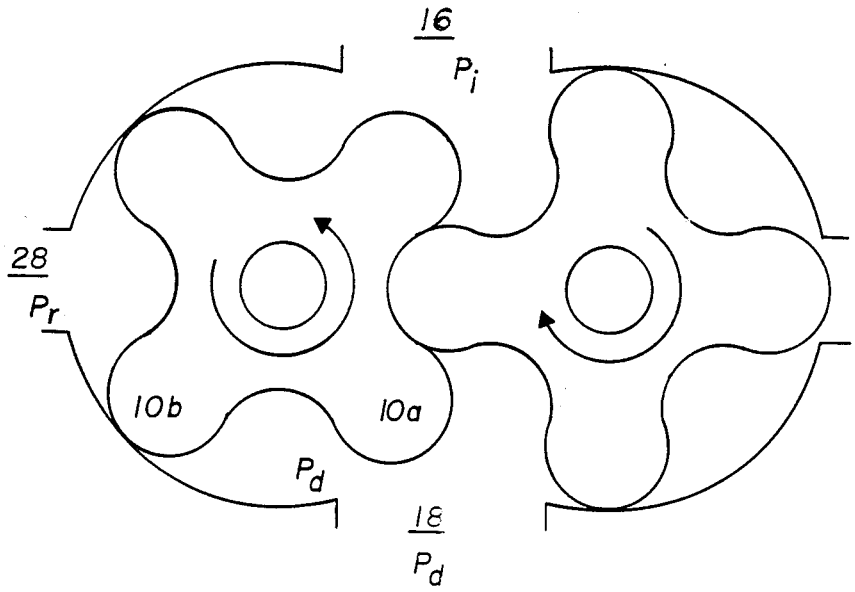

In the last stage, illustrated in FIG. 8, the impeller lobe 10*a* passes the leading edge of the discharge port 18 and the parcel of gas at pressure $P_r$ between lobes 10*a* and 10*b* is swept into the discharge port 18, and is thereby compressed to the final discharge pressure $P_d$. The net result of the stages illustrated in FIGS. 2 through 8 that the original parcel of gas trapped beween the lobes 10*a* and 10*b* at inlet pressure $P_i$ has been transferred to the discharge port and compressed to pressure $P_d$. The heating that attends this compression is adiabatic and depends on the difference between the discharge pressure $P_d$ and the recirculation pressure $P_r$, which in turn depends on the pressure drop across the heat exchanger 22. This difference in pressure, between the discharge pressure $P_d$ and the recirculation pressure $P_r$, is normally not greater than a few percent, such that there is only minimal heating of the gas passing through the compressor, and consequently only minimal heating of the compressor itself.

It will be noted that, with the illustrated impellers 10 and 12, which each have four lobes disposed at angles of 90° with respect to one another, it is necessary that the cylindrically curved interior housing walls 14*a* and 14*b* each extend through an angular sector of least 90° between the proximate edges of the inlet port 16 and the recirculation ports 28 and 30, and also between the proximate edges of the discharge port 18 and the recirculation ports 28 and 30. This requirement ensures that the inlet port 16 is never in direct fluid communication, through a displacement cavity, with either of the recirculation ports 28 and 30, and likewise ensures that the discharge port 18 is at no time in direct fluid communication with either of the recirculation ports 28 and 30.

It will be appreciated that one advantage of the embodiment thus far described is that the lobes of the impellers 10 and 12 do not at any time completely obstruct the recirculation ports 28 and 30 as the lobes pass by the ports. This is illustrated, for example, in FIG. 5, where it will be seen that, even when the lobe 10*a* is centered on the port 28, recirculation gas is free to flow into the displacement cavities on either side of the lobe 10*a*. As a consequence of this aspect of the invention there is no periodic closing of the recirculation ports, and consequently no periodic interruption of the flow of recirculation gas, as occurs in certain prior art compressors utilizing recirculation to cool the pump. Periodic interruption of the recirculation gas flow is undesirable because it results in a loss of momentum of the recirculation gas flow, with consequent heating and loss of flow of the recirculation gas.

Turning to another aspect of the invention, it will be noted from the Figures, particularly FIGS. 1 through 8, that both the absolute sizes and the relative sizes of the ports are selected so as to minimize flow losses in the gases passing through the compressor. The relative sizes of the ports are selected so as to maintain approximately constant flow velocity through all of the ports, as well as through the recirculation conduits 24 and 26. More specifically, the inlet port 16 and discharge port 18 are sized approximately equally to one another, as are the recirculation ports 28 and 30. Further, the inlet port 16 and discharge port 18 are each approximately twice the size of each of the recirculation ports 28 and 30. Additionally, the inlet port 16, the discharge port 18, and the recirculation ports 24 and 26 are all made as large as possible, consistent with the foregoing relationships and the physical constraints imposed by the sizes of the impellers 10 and 12 and the geometry of the housing 14. Making the ports as large as possible minimizes flow losses in gases flowing through the ports. Sizing the ports in this manner results in the flow velocities being both equal and as low as possible.

Having now described the invention in some detail, it is at this point instructive to consider the differences between the compressor of the present invention and the recirculating rotary pump disclosed and claimed in the above-referenced patent to Houghton. Houghton discloses rotary pumps having two- and three-lobed impellers, and various recirculation systems for returning cooled, high pressure gas to the pump so as to avoid the problems of overheating; and in this regard the Houghton pump is directed to some of the same objects and purposes of the present invention. The present invention, however, represents certain improvements over the pump disclosed by Houghton, which are best understood by a comparison of certain design features of the present invention with the construction of the Houghton pump. Accordingly, in the following paragraph, all references to figures, reference numerals and pump components are references to the Houghton patent.

Referring first to FIGS. 1 through 4 of Houghton, Houghton discloses a three-lobed impeller pump having recirculation ports 25 and 26. These ports are located at angles of at least 120 degrees from the gas inlet opening 21, so that the recirculation port, being at a higher pressure, is never in fluid communication with the inlet opening 21, as such would result in a momentary loss, or backflow, of gas directly from the recirculation ports 25 and 26 through the inlet opening 21. However, in order to accommodate this concern, it is necessary in the Houghton design of FIGS. 1 through 4 that the recirculation ports 25 and 26 are necessarily in direct communication with the gas outlet opening 24 during part of every cycle. This is best seen in the left-hand side of FIG. 3 of Houghton, where it will be appreciated that, as soon as the uppermost lobe impeller 16 passes the edge of the gas outlet opening 24, the recirculation port 26 will be momentarily in direct communication with the gas outlet opening 24. To the extent there is any pressure differential between the recirculation gas and the outlet gas, there will be backflow of the outlet gas into the recirculation port 26.

It will be noted that the compressor of the present invention overcomes this problem by isolating the recirculation gas from both the inlet port 16 and the outlet port 18.

Figure 6:
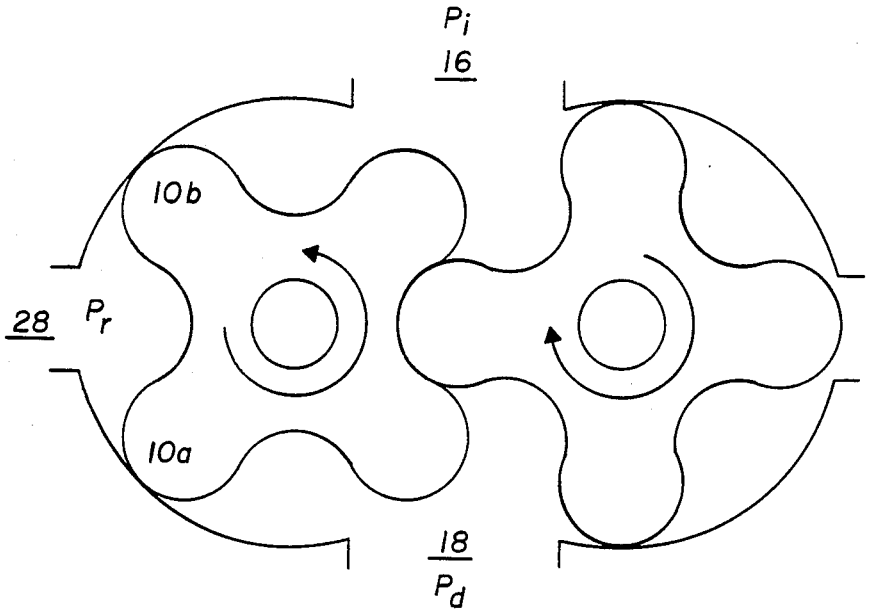

Houghton also discloses, in FIGS. 5 through 7 of the Houghton patent, an arrangement wherein the recirculation ports 43 and 44 are located in the end walls of the pump housing. This arrangement has the relative advantage of the recirculation ports not being at any time in communication with either the gas inlet opening 21 or the gas outlet 24, but suffers from the relative disadvantage that the flow of recirculation gas is momentarily interrupted with each passing of an impeller lobe. Also, it is noted that with the three-lobed impeller design it is not possible to locate the recirculation ports in the semicylindrical housing walls, as is done in the present invention, because the cylindrically curved impeller heads could not provide the sealing of the recirculation that is required in a three-lobed design to prevent backflow of the recirculation gas into the gas inlet opening. This is a significant disadvantage, because it limits the size of the recirculation ports and does not allow them to extend the length of the impellers, as is the case of recirculation ports located in the curved housing walls. Additionally, the presence of timing gears outside the end walls generally will limit the placement of the endwall ports to only one end of the pump.

The two-lobed design of Houghton, illustrated in FIGS. 8 and 9 of Houghton, suffers from the same relative disadvantage as the three-lobed design discusssed above, in that the outlet port and the recirculation ports are not isolated from one another, allowing for backflow and consequent decrease in cooling efficency. Also, as noted in Houghton, the necesary close proximity of the recirculation port to the discharge port results in the recirculation fluid being admitted to the displacement cavity very late in the cyle, just as the displacement cavity is opened to the discharge port, thereby reducing the efficiency of the cooling by the recirculation fluid.

Figure 10:
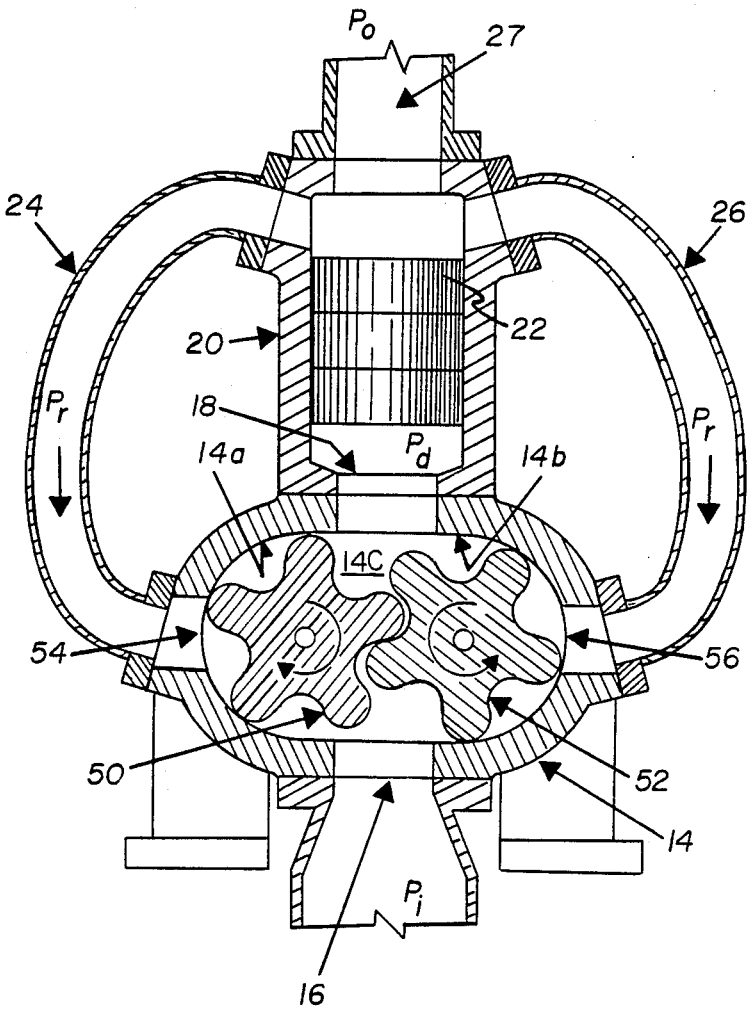
FIG. 10 is a schematic side view of an alternative embodiment of the compressor of the present invention, having five-lobed impellers.

FIG. 10 illustrates an alternative embodiment of the present invention wherein there are a pair of impellers 50 and 52 which each have five lobes. All of the like-numbered components of this embodiment are the same as in the embodiment described above. In addition to the use of five-lobed impellers 50 and 52, the principal difference between the embodiment shown in FIG. 10 and the previously described embodiment is there are recirculation ports 54 and 56 which are somewhat larger than the recirculation ports 28 and 30 of the previously described embodiment. This is possible because of the relatively smaller angle between the lobes of a five-lobed impeller than between the lobes of the four-lobed impellers described above. To ensure against direct fluid communication between either the inlet port or the discharge port and the recirculation ports, the cylindrically curved walls in the alternative embodiment must extend at least through an anglular sector of seventy two degrees from the proximate edges of the inlet port and each of the recirculation ports, and also between the proximate edges of the discharge port and the recirculation ports. This is also to say that the interior housing walls are cylindrically curved over an angular sector of 215°. In all other regards, the operation and construction of the alternative embodiment are substantially the same as the four-lobed embodiment described above. It will be recognized that, with impellers having five lobes and thus a smaller angle between adjacent lobes than in an impeller having four lobes, the inlet and outlet ports can be made larger. The relative disadvantage of this design is that the volumetric efficiency is somewhat smaller than than of a four-lobed design, as the volumetric efficiency generally decreases with increasing number of lobes.

The high pressure ratio capability of the compressor of the present invention is a consequence of the fact that the pressure gain in the housing is largely a result of flow work, which results from optimizing the recirculation of discharge gas, as opposed to adiabatic compression. With increasing pressure ratios flow work becomes asymptotic, whereas temperature increases due to adiabatic compression are exponential.

It is believed that the compressor of the present invention will find application in a wide variety of uses where high volume pumping capacity is required at pressure ratios of up to approximately ten to one (10:1). Inasmuch as Roots type compressors have previously only been capable of operating at sustained pressure ratios of approximately four to one (4:1), due to the overheating limitations described above, the higher pressure ratio capability of the present invention will make it useful in a variety of applications where the use of positive displacement rotary Roots compressors has not previously been considered feasible. These new applications will indeed be useful, because of the advantages of positive displacement rotary pumps mentioned earlier; namely, simplicity, high volumetric efficiency and the lack of rubbing or reciprocating mechanical parts.

Although the present invention is described herein by reference to a preferred embodiment, it will be understood that various modifications, variations and substitutions which may be apparent to one of ordinary skill in the art may be made without departing from the essence of the invention. Accordingly, the present invention is defined by the following claims.

What is claimed is:

1. A positive displacement recirculating rotary compressor comprising a housing having two mutually opposing cylindrically curved interior side walls, said housing including a gas inlet port at one end located between said mutually opposing cylindrically curved side walls, and a gas discharge port located at the opposite end of said housing from said inlet port and also located between said mutually opposing cylindrically curved interior side walls, said housing further including first and second gas recirculation ports formed respectively in said cylindrically curved side walls between said inlet port and said discharge port, first and second involutely lobed impellers journalled for rotation in opposite directions within said housing, each of said impellers having at least four lobes, said impellers being intermeshed so as to form a high-impedance seal when said impellers are rotated in opposite directions, said discharge port being connected in fluid communication with a discharge conduit, heat exchange means located in said discharge conduit operable to cool gas discharged from said discharge port of said housing, and first and second recirculation conduit means connected in fluid communication with said discharge conduit and connecting said discharge conduit respectively to said first and second recirculation ports, said inlet port and said discharge port being approximately equal in size to one another, and said first and second recirculation ports being approximately equal in size to one another, and said discharge port being approximately twice the size of each of said recirculation ports, and said inlet, discharge and recirculation ports further being as large as possible within the constraints of the foregoing relationships, whereby gas discharged from said housing is cooled by said heat exchange means and returns to said housing through said recirculation ports so as to reduce heating of said impellers, and with the sizing of said inlet, discharge and recirculation ports resulting in minimal flow losses.

2. The positive displacement recirculating rotary compressor defined in claim 1 wherein each impeller has four lobes.

3. The positive displacement recirculating rotary compressor defined in claim 2 wherein said cylindrically curved interior walls of said housing extend through anglular sectors of at least ninety degrees between the proximate edges of said inlet port and said recirculation ports, and between the proximate edges of said discharge port and said recirculation ports, such that said inlet port is isolated from direct fluid communication with said recirculation ports and said discharge ports is isolated from direct fluid communication with said recirculation ports.

4. The positive displacement recirculating rotary compressor defined in claim 1 wherein each impeller has five lobes.

5. The positive displacement recirculating rotary compressor defined in claim 4 wherein said cylindrically curved interior side walls of said housing each extend through angular sectors of at least seventy two degrees between the proximate edge of said inlet port and the respective recirculation port, and between the proximate edge of said discharge port and the respective recirculation port, such that said inlet port is isolated at all times from direct fluid communication with said recirculation ports, and said discharge port is also isolated at all times from direct fluid communication with said recirculation ports.

* * * * *